United States Patent [19]

Fishman

[11] Patent Number: 4,984,498

[45] Date of Patent: Jan. 15, 1991

[54] PERCUSSION TRANSDUCER

[76] Inventor: Lawrence Fishman, 76 Grove St., W. Medford, Mass. 02155

[21] Appl. No.: 403,378

[22] Filed: Sep. 6, 1989

Related U.S. Application Data

[63] Continuation-in-part of Ser. No. 112,289, Oct. 26, 1987, abandoned.

[51] Int. Cl.[5] ..... G10H 3/14; G10H 3/12

[52] U.S. Cl. ..... 84/730; 29/594; 84/723; 84/743; 84/DIG. 12; 84/DIG. 24

[58] Field of Search ..... 84/723, 730, 732, 743, 84/402, DIG. 24, DIG. 12; 29/594, 25.35; 381/114; 310/324, 328, 329, 339

[56] References Cited

U.S. PATENT DOCUMENTS

| | | | |
|---|---|---|---|
| 2,808,522 | 10/1957 | Dranetz | 310/329 X |
| 3,170,076 | 2/1965 | Wing | 310/329 X |
| 4,368,400 | 1/1983 | Taniguchi et al. | 310/345 X |
| 4,371,804 | 2/1983 | Peng et al. | 310/329 X |
| 4,479,412 | 10/1984 | Klynas | 84/DIG. 24 |
| 4,562,740 | 1/1986 | Webber et al. | 29/25.35 X |
| 4,630,465 | 12/1986 | Hatlou | 310/324 X |
| 4,660,410 | 4/1987 | Asano | 310/324 X |
| 4,672,839 | 6/1987 | Takeuchi et al. | 310/329 X |
| 4,737,676 | 4/1988 | Engel et al. | 310/324 X |

*Primary Examiner*—A. T. Grimley
*Assistant Examiner*—Matthew S. Smith
*Attorney, Agent, or Firm*—Wolf, Greenfield & Sacks

[57] ABSTRACT

A percussion instrument transducer for converting a striking impact into a representative electrical impulse triggering signal. The transducer is formed of a piezoelectric member of disc shape secured to an electrically conductive disc. The piezoelectric member and disc are supported in a housing on a support platform of smaller diameter than the diameter of the disc so that the periphery of the disc is cantilevered beyond the support platform to provide enhanced piezoelectric impulse action.

26 Claims, 3 Drawing Sheets

PERCUSSION TRANSDUCER

RELATED APPLICATIONS

This application is a continuation-in-part-of application Ser. No. 07/112,289 filed Oct. 26, 1987, and now abandoned.

BACKGROUND OF THE INVENTION

1. Field of the Invention

The present invention relates in general to a percussion transducer and pertains, more particularly, to a musical instrument percussion transducer. Even more particularly, the present invention relates to a piezoelectric type of percussion transducer.

2. Objects of the Invention

It is an object of the present invention to provide an improved percussion transducer, and in particular a piezoelectric type transducer. The transducer of the present invention is adapted to provide for transduction in association with a percussion instrument and in the disclosed embodiment it is particularly adapted for use with an acoustic drum.

Another object of the present invention is to provide a percussion transducer that is adapted to convert a striking impact into a representative electrical impulse triggering signal. The transducer of the present invention is in particularly adapted to be used as a triggering device rather than a sound following device.

A further object of the invention is to provide a percussion instrument transducer that has enhanced impulses output in response to initial impact on the instrument.

Still another object of the invention is to provide an improved percussion transducer that is simple in design, that can be fabricated quite inexpensively, that provides superior operation, and that can be assembled in simple steps.

SUMMARY OF THE INVENTION

To accomplish the foregoing and other objects, features and advantages of the invention there is provided a percussion transducer for converting a striking impact into a representative impulse triggering signal. The transducer comprises a piezoelectric member and an electrically conductive disc means. The piezoelectric member may comprise a piezoelectric disc having oppositely-disposed planar electrodes on either side thereof. These electrodes may be silver electrodes. Means are provided for fixedly supporting the piezoelectric member on an upper surface of the disc means. This means for fixedly supporting may comprise a conductive adhesive such as a conductive epoxy. The disc means itself may be comprised of either a thin beryllium disc or a thin brass disc.

The transducer further comprises a housing having an interior chamber in which is disposed both the piezoelectric member and disc means. The housing includes a support base for fixedly supporting the disc means at a lower surface thereof. Lead means are provide coupling to the piezoelectric member for deriving a signal therefrom. The housing may further include a cover for completely enclosing a piezoelectric member and disc means. An adhesive such as an epoxy may also be used for fixedly securing the disc means to the support base.

In accordance with the one feature of the present invention the base preferably includes a support platform of smaller diameter than the disc means so that the periphery of the disc means is cantilevered beyond the support platform to provide enhanced piezoelectric impulse action. This platform has a diameter D1 and the disc means has a diameter D2. It is preferred that the diameter D1 be in a range on the order of 25% to 75% of the diameter D2. In this regard, if the diameter D1 is too small than there is not sufficient support for the piezoelectric member. On the other hand if the diameter D1 is too large then the output signal is degraded (loss of sensitivity).

In accordance with another feature of the present invention, a relatively thin covering layer is preferably provided over the top surface of the piezoelectric disc. This layer is preferably an adhesive layer of, for example, silicone RTV adhesive. This is a room temperature vulcanizing adhesive that essentially does not "harden", but instead stays in a relatively resilient state that is resilient and soft to the touch. This resilient layer dampens high-frequency resonances, functions as a reinforcement for the solder joint on the top of the piezoelectric member and furthermore adds some mass to the transducer functioning as a means for controlling the output voltage by controlling the placement of the peripheral edge of this layer.

BRIEF DESCRIPTION OF THE DRAWINGS

Numerous other objects, features and advantages of the present invention should now become apparent upon a reading of the following detailed description taken in conjunction with the drawings, in which.

DETAILED DESCRIPTION

Figure 1:
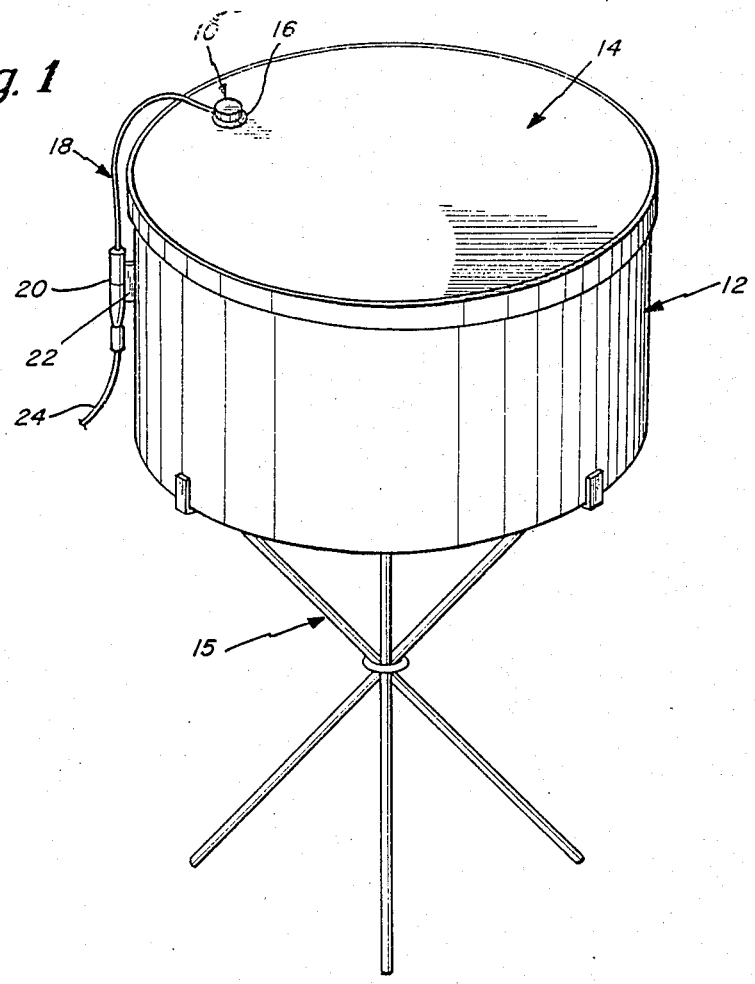
FIG. 1 is a perspective view illustrating the transducer of the present invention as used with an acoustic drum such as a snare drum.

Reference is now made to FIG. 1 which is a perspective view illustrating the transducer of the present invention at 10 secured to a percussion instrument. FIG. 1 in particular illustrates a drum 12 that may be a snare drum with the conventional drum head 14. In FIG. 1 the drum 12 is simply shown supported from a drum stand at 15.

Although the percussion transducer of the present invention described herein is illustrated in a preferred embodiment as being associated with a drum, the device can also be used as a triggering device in association with various types of electronic musical instrument equipment. The transducer of the present invention may in particular be used with a musical instrument digital interface in which case the transducer need not be secured directly on the instrument, but can be used as an input, but can be struck directly or indirectly to provide an input signal to a musical instrument controller of some type.

The transducer 10 of the present invention is secured to the drum head 14 such as with the use of a double sided tape illustrated at 16 in FIG. 1. Also refer to FIG. 3, to be described hereinafter. The double-sided tape 16 may be a foam rubber tape. It may be a closed-cell, high-density neoprene acrylic or butyl rubber adhesive tape that typically is provided with a protective release paper.

FIG. 1 also illustrates the lead 18 extending to a connector 20 which in turn is supported by a bracket 22 from the side of the drum body. Also illustrated in FIG. 1 is a second lead 24 coupling from the connector 20. The lead 24 may connect to some electronic gear including an amplifier and other electronic processing circuitry responsive to a signal from the transducer 10. Each of the leads 18 and 24 typically includes a center conductor and an outer conductor usually in the form of a shield.

The percussion instrument transducer of the present invention is adapted to convert a striking impact, such as occurs when the drum head is struck with a drum stick, into a representative electrical impulse triggering signal.

Figure 3:
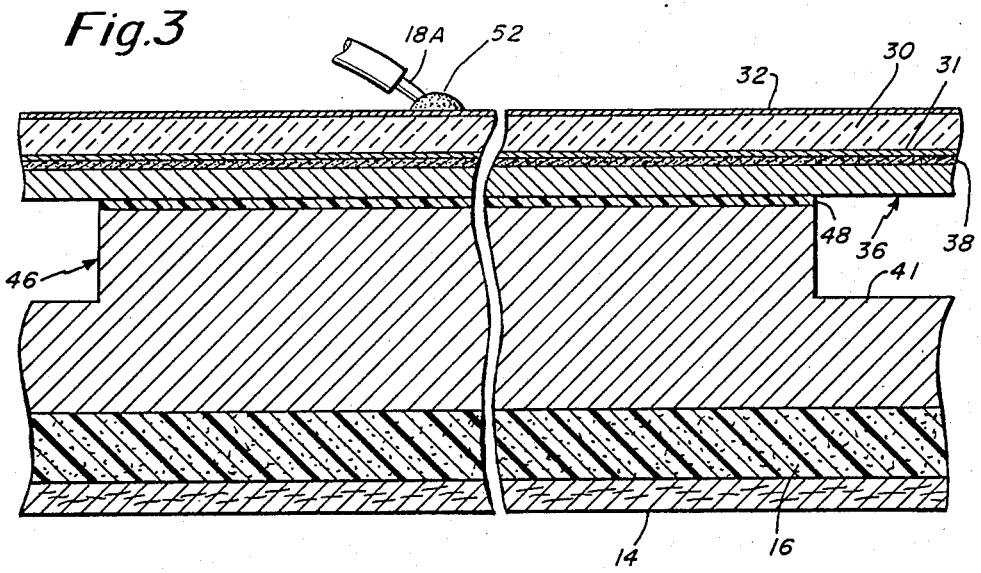
FIG. 3 is a more detailed cross-sectional view as taken along line 3—3 of FIG. 2.

The transducer is comprised of a piezoelectric member in the form of a piezoelectric disc 30 supported upon an electrically conductive disc 36 preferably of beryllium or brass. Both the piezoelectric member and the disc are relatively thin. The piezoelectric member 30 may be 10 mils thick while the disc 36 may be about 8 mils thick. The piezoelectric member 30, as illustrated in FIG. 3, has electrodes on either opposite upper and lower surfaces thereof. These are illustrated in FIG. 3 as silver electrodes 31 and 32.

Reference has been made herein to the piezoelectric member 30. This is illustrated as being of disc or circular shape but could likewise be of other form such as square or rectangular. Although reference has been made to this particular device as being a piezoelectric member, or crystal a more technically accurate term is piezoelectric ceramic. A crystal usually refers to a single crystal structure such as quartz. However, the materials employed herein are amorphous structures containing many thousand individual crystals. They are constructed by combining different elements in their powder form and subjecting them to high temperatures which forms a fused ceramic containing thousands of crystals. They are then subjected to high DC voltages which tends to align a majority of the dipoles and thus gives the entire structure a common polarity.

In one disclosed embodiment of the present invention the disc 36 may be constructed of either brass or beryllium. As indicated before it has thickness of 8 mils. The disc may have a diameter of ¾ inch. The piezoelectric member 30 may have a diameter of 9/16 inch.

The piezoelectric member 30 and the electrically conductive disc 36 are secured together as a unitary piece. In this regard refer to FIG. 3 that illustrates the securing of these pieces together by means of a conductive epoxy as illustrated at 38. Thus, the lower surface of the piezoelectric member, at the lower silver electrode 31, is secured to the top of the disc 36 by means of a conductive epoxy thus providing conductivity from the lower electrode 31 to the disc 36.

Figure 2:
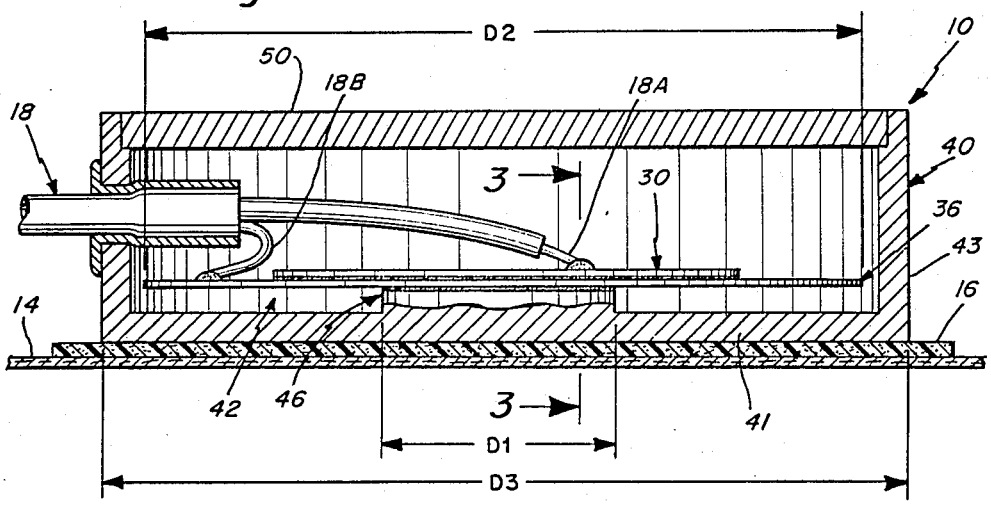
FIG. 2 is a cross-sectional view through the transducer illustrated in FIG. 1.
Figure 4:
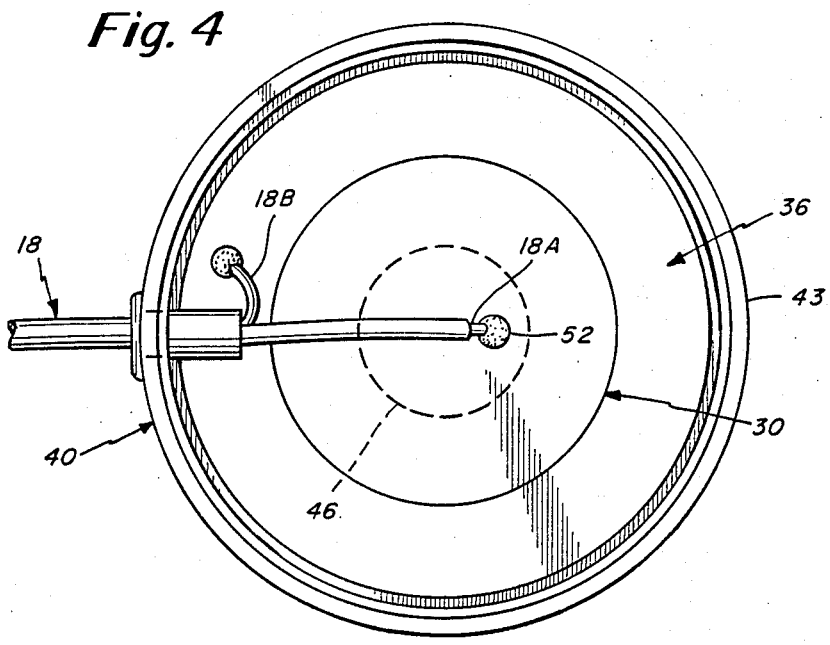
FIG. 4 is a plan view of the transducer of FIG. 2 with the cover removed.

FIG. 2–4 also illustrate the housing 40 that includes a bottom 41 and an outer peripheral wall 43 that together define an interior chamber 42 in which is disposed the piezoelectric member and disc. As illustrated in FIGS. 2 and 3, the housing bottom 41 has at its center area, extending upwardly therefrom, a support platform 46. It is noted, in FIG. 2, that the platform 46 has a diameter D1. The disc 36 has a diameter D2 while the overall outer diameter of the housing is illustrated by diameter D3.

It is noted that the support platform 46 is dimensioned so that at least some portion of the periphery of the disc 36 extends therebeyond. The disc 36, and the piezoelectric member supported therefrom, are essentially cantilevered about the periphery beyond the support platform 46.

The disc 36, as illustrated in FIG. 2, is dimensioned so as to fit snugly in the interior chamber 42 of the housing 40. The disc 36 is supported at its bottom surface on the support platform 46 by means of an adhesive. This adhesive may be a silicone RTV adhesive illustrated in FIG. 3 applied at 48. The adhesive 48 is a resilient adhesive that has some pliability thereto even in the cured state thereof.

As indicated previously, the transducer of the present invention is in particular designed to provide a triggering impulse rather than providing some type of an analog output. This triggering type of response is obtained, to a great extent, by virtue of providing the support platform 46 and using the cantilevering of the disc and associated piezoelectric member. This cantilevering is provided by virtue of having the disc 36 of a diameter D2 that is greater than the diameter D1 of the platform 46. It has been found that the diameter D1 is preferably in a range on the order of 25%–75% of the diameter D2. If the diameter D1 is larger, beyond this range, then there is a substantial loss in sensitivity of the device. If the diameter is too small, below this range, then there is not sufficient support for the disc and piezoelectric member.

As indicated previously, the transducer of the present invention, such as illustrated in FIG. 1, is secured to the drum head by means of a double sided adhesive. This is also illustrated in FIG. 3 by the adhesive 16 shown adhered to the bottom 41 of the housing 40.

With respect to the housing 40, it is also noted that the housing is enclosed by means of a cover 50 that may be force fit with the housing 40 or alternatively there could be some type of screw engagement between the cover 50 and the housing 40.

Also illustrated in the drawing is the lead 18 coupling to the transducer. The lead 18 may couple through a hole in the housing. This hole may be provided in the peripheral side wall 43. The lead 18 is illustrated as including two conductors, a center conductor and an outer conductor which is usually a shield. The center conductor 18A is soldered to the top of the piezoelectric member 30. This may be soldered as illustrated in FIG. 3 by the solder joint at 52. The lead 18A is soldered to the top electrode 32 of the piezoelectric member. The other lead 18B is soldered as illustrated in FIG. 2 to the metal disc 36.

The embodiment of the transducer illustrated in FIGS. 1–4 herein may be fabricated in the following way. The piezoelectric disc 30 is secured to the top side of the metal disc 36 with the use of a conductive epoxy. These two members then form a unitary piece that is secured in the housing chamber 42. The bottom side of the metal disc 36 is then adhesively secured to the support platform 46 in the base of the housing. Next, the lead 18 is preferably passed through a hole in the side wall of the housing. An eyelet is employed for holding the lead inside of the housing. The eyelet may be crimped on the inside to hold the lead and prevent it from being withdrawn from the housing. The two wires 18A and 18B are then soldered to the respective members 30 and 36.

Figure 5:
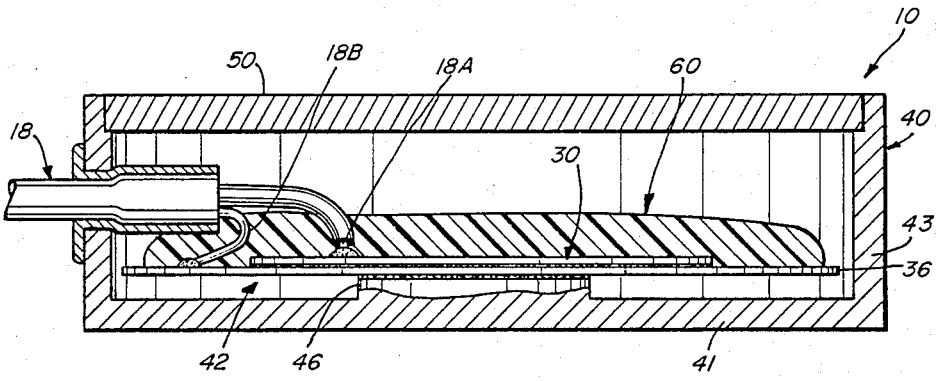
FIG. 5 is a detailed cross-sectional view of an alternate embodiment of the present invention employing a resilient layer over the piezoelectric member.
Figure 6:
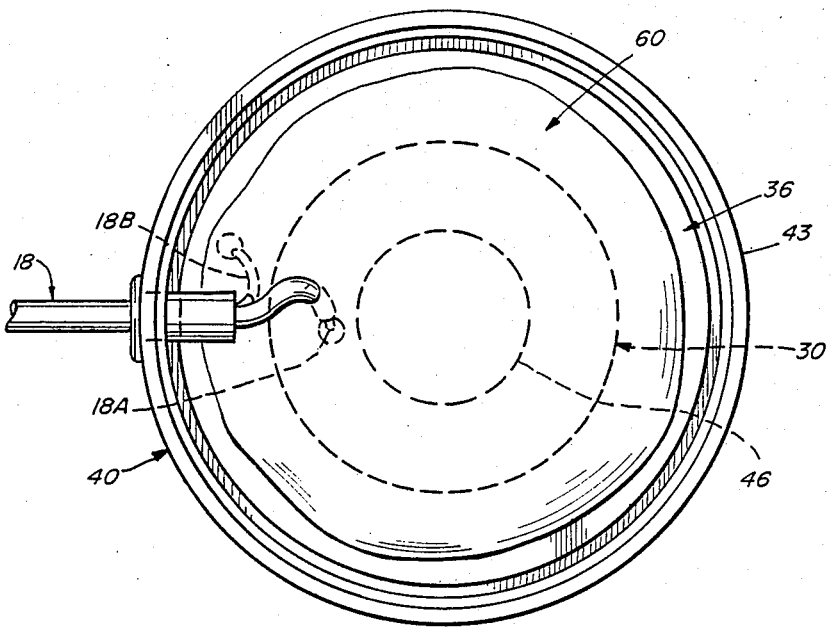
FIG. 6 is a plan view of the transducer of FIG. 5 with the cover removed.

Reference is now made to FIGS. 5 and 6 for an illustration of an alternate embodiment of the present invention. This particular embodiment has been found to provide improved performance. This improved performance is attributed to the addition of the layer 60 as illustrated in FIGS. 5 and 6.

In FIGS. 5 and 6, like reference characters have been used throughout the drawing to identify parts thereof that are substantially identical to parts previously described in the first embodiment of the invention such as illustrated in FIGS. 2–4. In the embodiment of FIGS. 5 and 6, the transducer includes the electrically conductive disc 36 and the piezoelectric disc 30. These are fastened together in the same manner as previously described. Also, the unitary transducer structure is fastened to the platform 46 by a preferred resilient adhesive such as the aforementioned RTV adhesive. The same type of an adhesive is also used for the layer 60. The layer 60 comprises an adhesive layer that is pliable even when cured.

The layer 60 provides a number of advantages. The material that is used is, as mentioned, a silicone RTV adhesive. This has a low viscosity and a self-leveling characteristic. The layer 60 provides a dampening, particularly of high-frequency resonance signals. Furthermore, the layer 60 functions as a reinforcement for the solder joint at the top of the piezoelectric crystal. Actually, in the embodiment illustrated in FIG. 5, the layer 60 extends over both solder joints as noted in FIG. 5 and, thus, has the effect of reinforcing the joints. Many times the leads are of relatively thin and delicate wire and, thus, a reinforcement at that point is most advantageous.

The layer 60 furthermore adds some mass to the transducer. The amount of mass depends upon how far the adhesive layer flows outwardly at is periphery. In accordance with the invention, proper acoustic results have been found to occur when the layer 60 extends at least in a diameter equal to that of the diameter of the platform 46. Preferably, the layer 60 extends to cover the piezoelectric disc 30 and to extend at least partially onto the metal disc 36. The added mass, particularly at the periphery of the layer 60, can be used to control the output voltage and essentially trim the output provided by the transducer. By experimentation, it has been found that good results are obtained when the peripheral edge of the layer 60 is at about the midpoint between the respective peripheries of the discs 30 and 36.

In connection with the procedures for fabrication of the transducer of the FIGS. 5 and 6, the same procedures previously set forth are employed. The layer 60 is essentially the last step taken in the formation of the transducer.

Having now described a limited number of embodiments of the present invention it should now be apparent to those skilled in the art that numerous other embodiments and modifications thereof are contemplated as falling within the scope of the present invention as defined by the appended claims.

What is claimed is:

1. In combination, a percussion transducer for a musical percussion instrument, said transducer for mounting on the said instrument and for converting a striking impact into a representative electrical impulse triggering signal, said transducer comprising:

a piezoelectric disc having oppositely disposed electrodes on either side thereof including top and bottom electrodes, an electrically conductive disc, means fixedly supporting said bottom electrode of said piezoelectric disc to an upper surface of said conductive disc, a housing having an interior chamber in which is disposed said piezoelectric disc and conductive disc, said housing including a bottom wall having a support platform for supporting said conductive disc at a lower surface thereof, said housing further having a peripheral side wall defining a diameter of the housing that is greater than the diameter of the conductive disc and greater than the height of the housing, said support platform being of smaller dimension than said conductive disc so that the periphery of said conductive disc is cantilevered beyond said support platform to provide enhanced piezoelectric impulse action, lead means coupling to at least said piezoelectric disc for deriving a signal therefrom, adhesive means for resiliently securing the conductive disc at its lower surface to the top surface of said support platform, and means for securing the transducer to the instrument.

2. A percussion transducer as set forth in claim 1 wherein said adhesive means comprises a silicone RTV adhesive.

3. A percussion transducer as set forth in claim 1 wherein the support platform has a diameter D1 and the conductive disc has a diameter D2, and wherein the diameter D1 is in a range on the order of 25% to 75% of the diameter D2.

4. A percussion transducer as set forth in claim 1 wherein said piezoelectric disc and said conductive disc are both relatively thin having a thickness at least an order of magnitude less than the height of the housing.

5. A percussion transducer as set forth in claim 1 wherein the electrodes are silver electrodes.

6. A percussion transducer as set forth in claim 1 wherein the means for fixedly supporting the piezoelectric disc to the conductive disc comprises a conductive adhesive.

7. A percussion transducer as set forth in claim 6 wherein said conductive adhesive comprises a conductive epoxy.

8. A percussion transducer as set forth in claim 1 wherein said conductive disc comprises a thin beryllium disc.

9. A percussion transducer as set forth in claim 1 wherein said conductive disc comprises a thin brass disc.

10. A percussion tranducer as set forth in claim 1 wherein said housing further comprises a cover for completely enclosing the piezoelectric disc and conductive disc.

11. A percussion transducer as set forth in claim 1 wherein said lead means has two wires, one secured to the piezoelectric disc and the other to said conductive disc.

12. A percussion transducer as set forth in claim 1 wherein said lead means includes one lead secured to said top electrode of the piezoelectric disc and another lead secured to the conductive disc.

13. A percussion transducer as set forth in claim 12 wherein the piezoelectric disc is of smaller diameter than the diameter of the conductive disc with the other lead secured to the exposed top edge area of the conductive disc.

14. A percussion transducer as set forth in claim 13 wherein said housing has a hole in the peripheral side wall thereof to receive said lead means.

15. A percussion transducer as set forth in claim 14 including an eyelet in said hole encrimped to secure said lead means.

16. A method of fabricating a percussion transducer for mounting on a percussion instrument and for converting a striking impact into a representative electrical impulse triggering signal, said method comprising the steps, providing a piezoelectric member, providing an electrically conductive disc means, securing the piezoelectric member and disc means together to form a unitary element, providing a housing having a diameter greater than its height and defining an interior chamber and a support platform, resiliently adhesively supporting said unitary element on the support platform and providing lead means coupling to at least said piezoelectric member for deriving a signal therefrom.

17. A method as set forth in claim 16 including further providing the support platform of smaller dimension then the disc means so that the periphery of the disc means is cantilevered beyond the support platform to provide enhanced piezoelectric impulse action.

18. A method as set forth in claim 17 wherein the support platform has a diameter D1 and the disc means has a diameter D2, and wherein the diameter D1 is in a range on the order of 25%–75% of the diameter D2.

19. A percussion transducer for mounting upon a percussion instrument, said transducer for converting a striking impact into a representative electrical impulse triggering signal, said transducer comprising; a piezoelectric disc having oppositely disposed electrodes on either side thereof, an electrically conductive disc, means fixedly supporting one electrode of said piezoelectric disc to an upper surface of said conductive disc, a housing for receiving said piezoelectric disc and said conductive disc, said housing including a bottom wall having a support platform for supporting said conductive disc at a lower surface thereof, adhesive means for resiliently securing the conductive disc at its lower surface to the top surface of said support platform, lead means coupled to at least said piezoelectric disc for deriving a signal therefrom, said adhesive means defining the only means for holding the conductive disc to the support platform, an unfilled air space being provided over the piezoelectric disc with an absence of contact of any retaining means to cover the piezoelectric disc except for the lead means, and means disposed over the top surface of said piezoelectric disc forming a resilient dampening layer that extends to cover at least the portion of the piezoelectric disc that overlies the support platform.

20. A percussion transducer as set forth in claim 19 wherein said housing further has a peripheral side wall defining a diameter of the housing that is greater than the diameter of the conductive disc and greater than the height of the housing.

21. A percussion transducer as set forth in claim 19 wherein said adhesive means comprises a resilient adhesive that has some pliability thereto even in the cured state of said adhesive means.

22. A percussion transducer as set forth in claim 21 wherein said adhesive means comprises a silicone RTV adhesive.

23. A percussion transducer as set forth in claim 21 wherein the support platform has a diameter D1 and the conductive disc has a diameter D2, and wherein the diameter D1 is in a range on the order of 25% to 75% of the diameter D2.

24. A percussion transducer as set forth in claim 19 wherein said means forming a resilient dampening layer comprises an adhesive layer that is pliable even when cured.

25. A percussion transducer as set forth in claim 24 wherein the resilient dampening layer extends to cover the entire piezoelectric disc.

26. A percussion transducer as set forth in claim 25 wherein the periphery of the resilient layer extends to a point intermediate of the peripheral edges of the respective piezoelectric and electrically conductive discs.

* * * * *